US005439120A

United States Patent [19]

Brozak

[11] Patent Number: 5,439,120

[45] Date of Patent: Aug. 8, 1995

[54] GRAVITY FED MERCHANDISING SYSTEM

[75] Inventor: Emory N. Brozak, Strongsville, Ohio

[73] Assignee: American Greetings Corporation, Cleveland, Ohio

[21] Appl. No.: 57,659

[22] Filed: May 4, 1993

[51] Int. Cl.[6] ..... A47F 5/00

[52] U.S. Cl. ..... 211/59.1; 206/806

[58] Field of Search ..... 211/59.1, 59.2, 54.1; 248/220.4, 220.3, 221.1; 206/315.1, 806, 292, 278

[56] References Cited

U.S. PATENT DOCUMENTS 2,764,384 9/1956 Kirsch .
2,842,329 7/1958 Friedman et al. .
3,568,852 3/1971 Howard .
3,897,926 8/1975 Silver .
4,072,246 2/1978 Paulin .
4,093,168 6/1978 Buril .
4,109,795 8/1978 Konigsford et al. .
4,132,316 1/1979 Schmidt, Jr. .
4,192,018 3/1980 Latina .
4,274,782 6/1981 de Rancourt de Mimerand et al. .
4,299,342 11/1981 Kessler et al. .
4,316,547 2/1982 Varon .
4,346,825 8/1982 Leger .
4,362,249 12/1982 Thalenfeld .
4,368,865 1/1983 Kolbe .
4,436,209 3/1984 Thalenfeld .
4,467,926 8/1984 Percival .
4,475,658 10/1984 Roberts .
4,540,093 9/1985 Merl et al. .
4,653,678 3/1987 Blanchard et al. .
4,674,721 6/1987 Thalenfeld .
4,705,175 11/1987 Howard et al. .
4,718,546 1/1988 Kolton et al. .
4,720,875 1/1988 Latina et al. .
4,723,663 2/1988 Learn .
4,742,923 5/1988 Calvert .
4,823,962 4/1989 Arias .
4,882,868 11/1989 Fast .
4,905,846 3/1990 Calvert .
4,936,565 6/1990 Fredrickson .
4,976,058 12/1990 Valiulis .
4,978,043 12/1990 Uke .
5,013,004 5/1991 Wilkins et al. ..... 206/806 X
5,014,957 5/1991 Nichol, Jr. ..... 206/806 X
5,080,238 1/1992 Hochman .
5,118,065 6/1992 Becklund et al. .
5,282,553 2/1994 Ibled ..... 206/292 X

*Primary Examiner*—Alvin C. Chin-Shue
*Assistant Examiner*—Sarah A. Lechok
*Attorney, Agent, or Firm*—Calfee, Halter & Griswold

[57] ABSTRACT

The merchandising system includes an upright store fixture and at least one hanger arm coupled with the upright store fixture. The hanger arm has (i) a gravity slide portion extending forwardly and angularly downward from a location on the front side of the upright store fixture, (ii) a stop member disposed on the gravity slide portion near the lower end thereof, (iii) a front portion extending forwardly from the lower end of the gravity slide portion, and (iv) a support device at the forward end of the front portion. At least one product/-clip combination is suspended from the hanger arm. The product/clip combination comprises a product (e.g., a baseball or softball glove or mitt) and a clip releasably engaging a predetermined portion of the product. The clip has a hook configured to releasably engage the hanger arm at any location rearward of the support device and to suspend the product/clip combination therefrom. The hook and the gravity slide portion of the hanger arm are configured to enable a product/clip combination suspended from the hanger arm to slide downward along the gravity slide portion under the influence of gravity when the hook engages the gravity slide portion. Each product/clip combination is removable from the hanger arm by moving the clip laterally relative to the hanger arm thereby to unhook the product/clip combination from the hanger arm.

19 Claims, 5 Drawing Sheets

GRAVITY FED MERCHANDISING SYSTEM

FIELD OF THE INVENTION

The present invention relates to a product merchandising system, and particularly to a gravity fed product merchandising system which is useful in the merchandising of baseball and/or softball gloves and mitts.

BACKGROUND AND SUMMARY OF THE INVENTION

Applicant believes that in a retail product merchandising system, it is desirable to organize, support and display products in an aesthetically attractive manner, and in a way that is "customer friendly" (i.e., in a way that makes it convenient for customers to identify the products that meet the customer's particular needs, to examine the products and to return unpurchased products to the system). It is also desirable that the system be space efficient, and that the system allow store personnel to conveniently replace, add to, or remove the stock of products being displayed by the system.

Applicant found that with products such as baseball and/or softball gloves and mitts, designing a product merchandising system to meet the foregoing objectives was particularly challenging, primarily because of the particular configuration of the gloves and mitts. As is well known, a baseball and/or softball glove or mitt generally has a front face which is concave to form a ball receiving pocket. The mitt has a hand receiving opening, a thumb stall and one or more finger stalls into which the wearer's fingers are at least partially inserted. The mitt also has a web or backstop secured to and extending between the margins of the thumb stall and the next adjacent finger stall (i.e., the index finger stall). The portions of the glove or mitt which form the pocket, the hand receiving opening, the thumb stall and the finger stalls are relatively thick, because they are padded or cushioned to protect a person's hand from impact from a baseball or softball. The web is relatively thin, because it does not cover a part of the person's hand. Such a glove or mitt configuration made it a challenge to design a merchandising system which can support and display baseball and softball gloves and mitts in a manner which is (i) aesthetically attractive, (ii) space efficient, (iii) consumer friendly, and (iv) convenient for enabling store personnel to replace, add to or remove the supply of gloves and/or mitts in the system.

The present invention provides a new and useful merchandising system designed to support and display products such as baseball/softball gloves and/or mitts in a manner which is (i) aesthetically attractive, (ii) space efficient, (iii) consumer friendly, and (iv) convenient for enabling store personnel to replace, add to, or remove the stock of items in the system.

Further, it should be understood that in this application reference to a product as a "glove" is intended to mean a baseball or softball glove or mitt.

According to the present invention, a product merchandising system includes an upright store fixture with a front side and one or more hanger arms coupled with the upright store fixture. Each hanger arm has (i) a slide (or descent) portion which extends forwardly and angularly downward from a location on the upright store fixture to allow for gravity feed of articles hung thereon, (ii) a stop member near the lower end of the slide portion, (iii) a front portion extending forward from the lower end of the slide portion to define a product replacement area, and (iv) a support device at the forward end of the front portion. The front portion of each hanger arm extends forward from the slide portion a sufficient distance to provide customers with a convenient location for returning a product that has been removed from a hanger arm and examined by the customer.

According to the preferred embodiment, one or more horizontal mounting bars are connected to the front side of the upright store fixture, and the rear end of each hanger arm has coupling structure configured to engage a horizontal mounting bar, to couple the hanger arm with the upright store fixture.

A plurality of product/clip combinations are suspended from each hanger arm. Each product/clip combination comprises a product and a clip releasably engaging a predetermined portion of the product. The clip has a hook configured to releasably engage the hanger arm at any location rearward of the support device and to suspend the product/clip combination from the hanger arm. The hook and the slide portion of the hanger arm are configured to enable a product/clip combination suspended from the hanger arm to slide downward along the slide portion under the influence of gravity. Moreover, the hook enables the product/clip combination to be removable from the hanger arm by moving the clip laterally relative to the hanger arm, thereby to unhook the product/clip combination from the hanger arm.

When the product comprises a glove, the clip releasably engages the web of the glove and suspends the glove in a predetermined orientation from a hanger arm. Specifically, the glove is suspended with the concave front face of the glove facing the forward end of the hanger arm. When a plurality of gloves are suspended in that orientation on the slide portion of a hanger arm, the gloves can stack up one behind the other in as space efficient a manner as possible. Also, because the gloves all have a common orientation (i.e., with their pockets facing forward), the system displays the gloves in an aesthetically attractive manner.

The clip preferably comprises a one piece member configured to define (i) a body portion, (ii) a hook, and (iii) at least one spring finger extending away from the body portion and being resiliently deflectable relative to the body portion, to enable the predetermined portion of the product to be captured between the spring finger and the body portion. Further, the body portion can include a recess for supporting display material related to the product.

Also according to the preferred embodiment, the support device at the forward end of each hanger arm comprises a plate coupled with the forward end of the hanger arm, and a display device is connected with the support plate. The display device is configured to support at least one segment of material which provides information (e.g., graphical and/or textual) which relates to the type of product on the hanger arm.

The system enables gloves to be organized in ways that make it simple and efficient for a customer to make a selection of a glove that meets the customer's particular needs. For example, the system enables gloves to be organized by types quality, prices etc. Moreover, the displays associated with the hanger arms inform customers as to what types of gloves are found on the hanger arms, what sport the gloves are used to play (e.g., baseball, softball), what position(s) the gloves are for (e.g., catcher's mitt, outfielder's glove, etc.), the price range(s) of the gloves, etc.

Further features of the present invention will become further apparent from the following detailed description and the accompanying drawings.

DETAILED DESCRIPTION OF THE PREFERRED EMBODIMENT

As described above, the present invention relates to a merchandising system which is particularly useful for supporting and displaying products such as baseball or softball gloves or mitts. The following detailed description relates to a merchandising system, constructed according to the principles of the invention, and particularly designed for supporting and displaying baseball or softball gloves or mitts (all of which are referred to in this application as "gloves"). However, it will also be clear to those of ordinary skill the manner in which the principles of this invention can be employed to produce merchandising systems for various other types of products.

Figure 1:
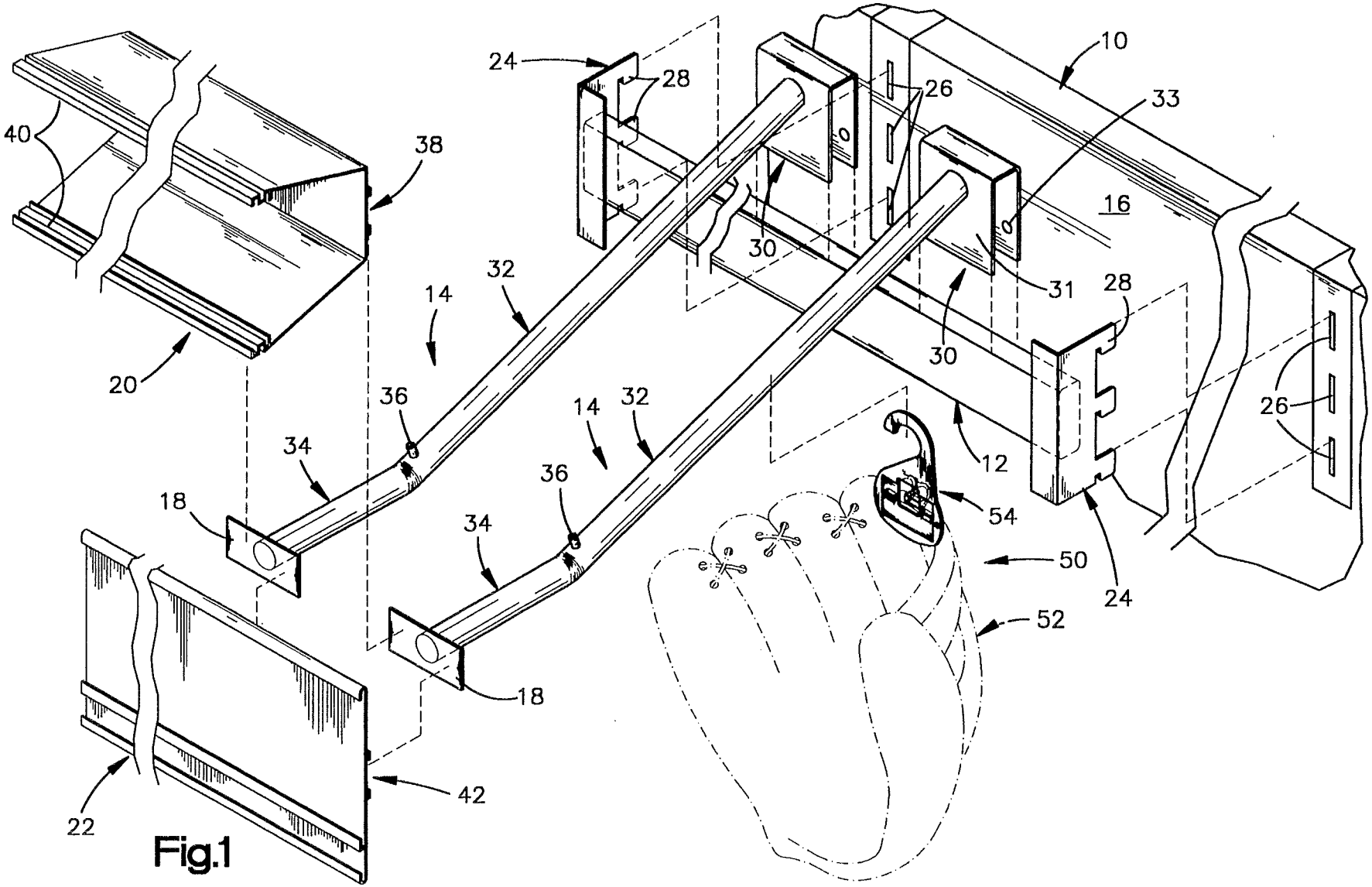
FIG. 1 is an exploded view of the principal components for forming a product merchandising system according the present invention.
Figure 3:
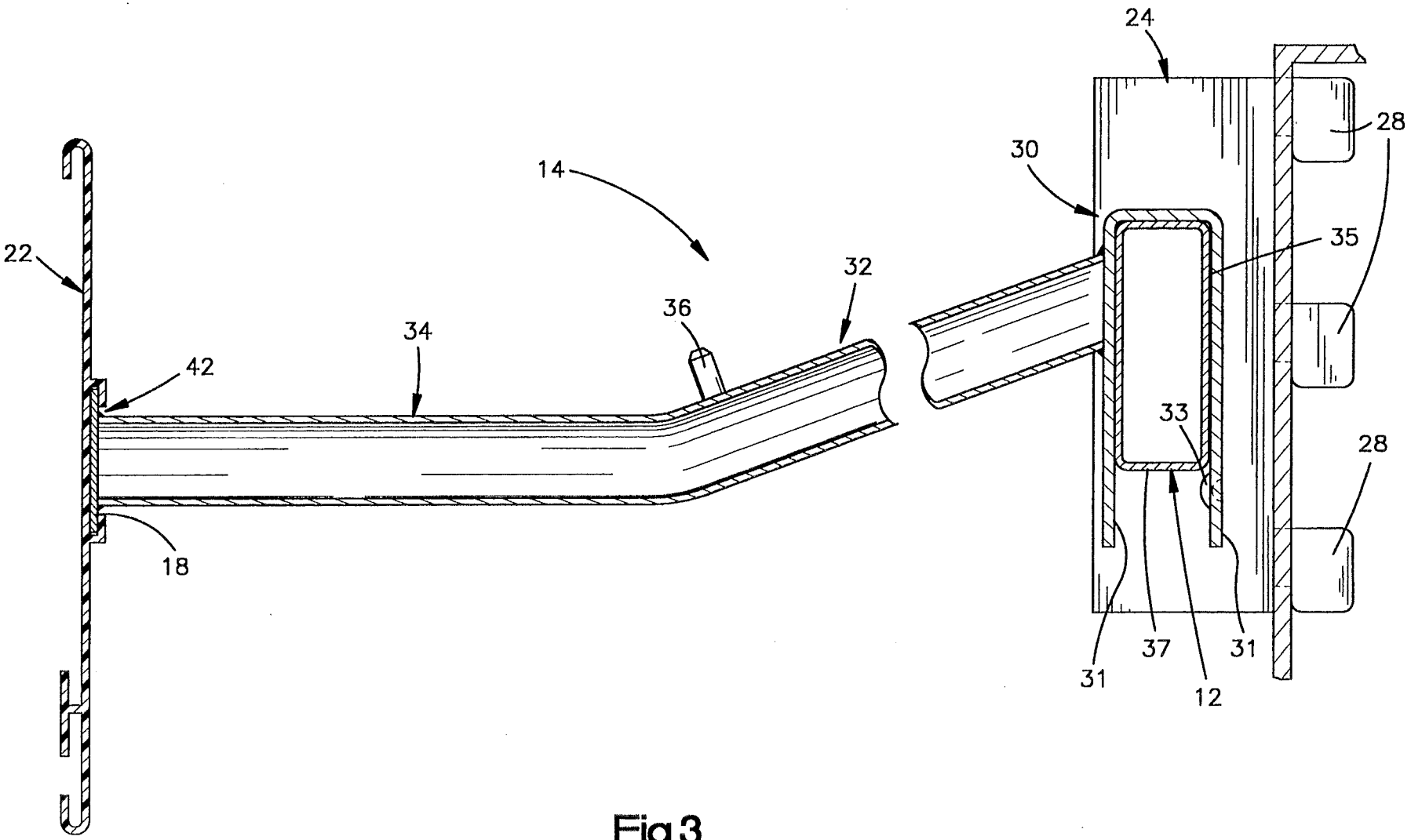
FIG. 3 is a sectional view of a hanger arm for a product merchandising system according to the present invention.
Figure 5:
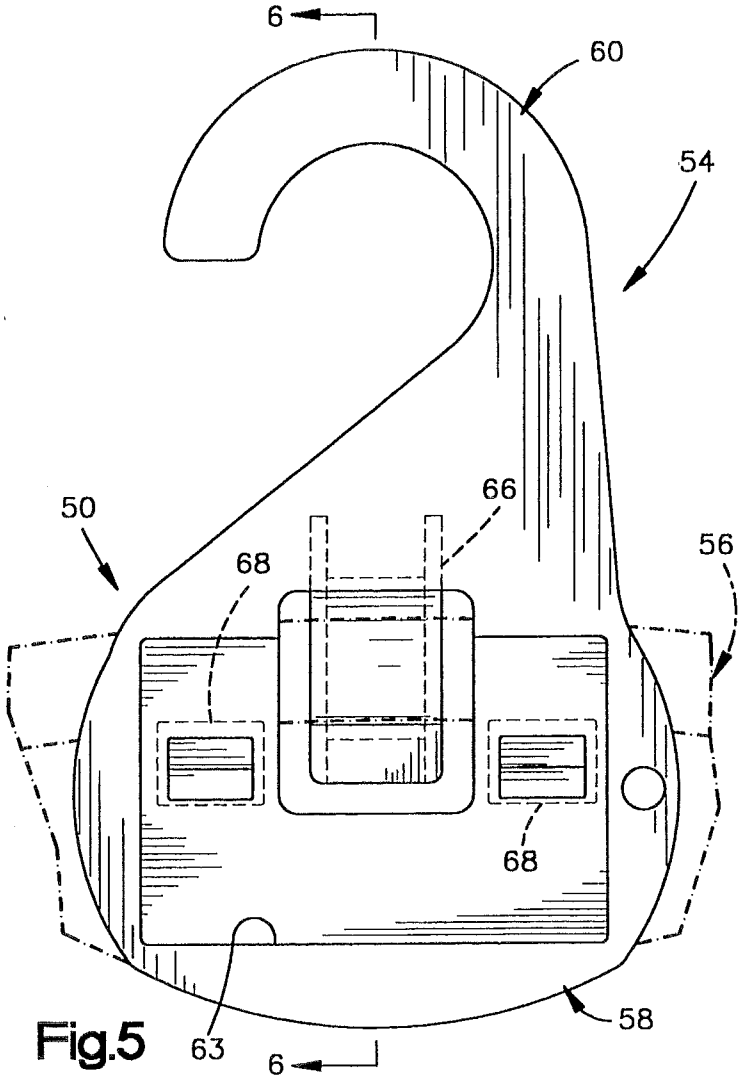
FIG. 5 is a front view of the product/clip combination of FIG. 4.
Figure 4:
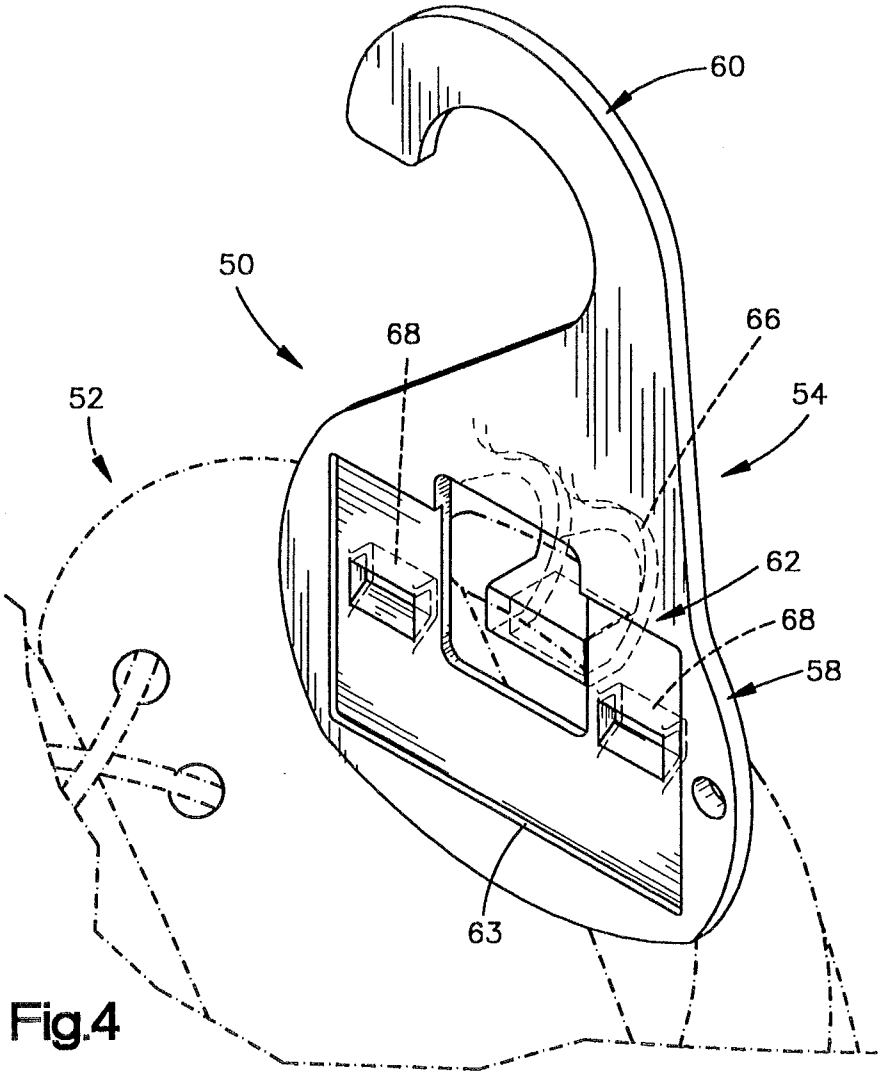
FIG. 4 is a perspective view of a product/clip combination for a product merchandising system according to the invention, with the product illustrated in phantom.
Figure 8:
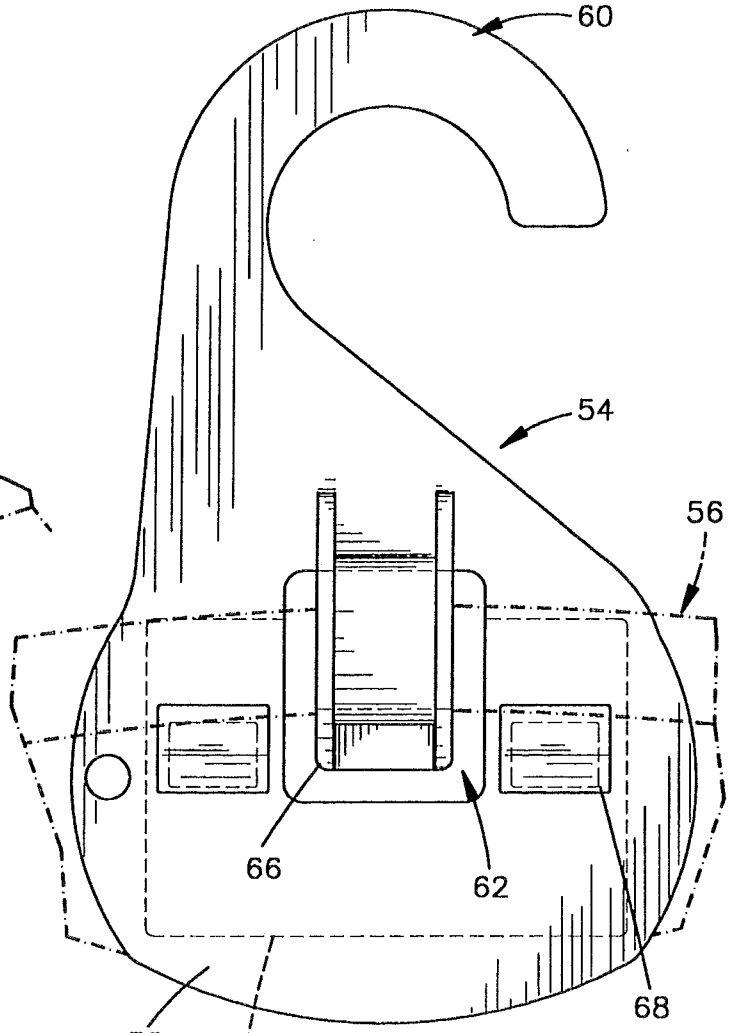
FIG. 8 is a rear view of the product/clip combination of FIG. 4.
Figure 7:
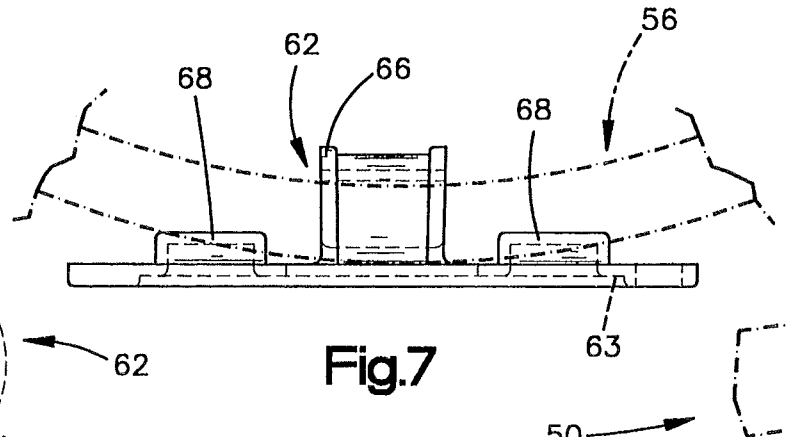
FIG. 7 is a top view of the product/clip combination of FIG. 4.

As illustrated in FIG. 1, the principal components of the merchandising system include an upright store fixture 10 which forms a foundation for the system, a horizontal mounting bar 12 designed for attachment to the upright store fixture 10, and one or more gravity feed hanger arms 14 which are adapted to be secured to the mounting bar 12. The store fixture 10 has a front side 16, and each hanger arm 14 extends forwardly with respect to the front side 16 of the store fixture. Further, each hanger arm 14 has a support device at its forward end, for supporting a display device associated with the system. As illustrated in FIG. 1, the support device at the end of the hanger arm 14 comprises a mounting plate 18, and two alternative types of display fixtures for attachment to the mounting plate(s) 18. One type of display fixture comprises a light fixture mounting channel 20 which can support an electrically actuated backlight and a display (not shown) designed to be illuminated by the backlight. An alternative type of display fixture comprises a graphics channel 22 which can be secured to one or more of the mounting plates 18 at the ends of the hanger arms (see e.g., FIG. 3) and forms a receptor for display material relating to the products supported and displayed by the system.

When the components of the merchandise display are assembled, the horizontal mounting bar 12 is secured to the front side 16 of the store fixture 10. The hanger arms 14 are secured to the horizontal mounting bar 12 with the hanger arms extending forwardly from the mounting bar 12 and the mounting plates 18 located at the front ends of the hanger arms 14. Alternatively, the hanger arms 14 could be secured directly to the upright store fixture 10.

The store fixture 10 comprises an upright fixture which extends upright from a base such as a gondola (not shown). Gondolas, and other types of base structures, and upright fixtures are well known and should require no further explanation. The mounting bar 12 basically comprises a zinc-plated, steel tube with bracket members 24 at its ends. The upright store fixture 10 includes a series of slots 26 for receiving the hooks 28 formed in one piece with the bracket members 24. The pattern of the hooks on the bracket members can have various configurations to match the pattern(s) of the slots on the upright store fixture.

Each gravity feed hanger arm 14 has a generally U-shaped clasp 30 at its rear end. The U-shaped clasp 30 is configured to fit snugly over the mounting bar 12. At least one of the legs 31 of the U-shaped clasp 30 has one or more inwardly directed stamped projections 33 (only one projection is shown in FIG. 1) o As the U-shaped clasp 30 is fitted downwardly over the mounting bar, the projection(s) 33 engage a side wall 35 of the mounting bar to force the legs 31 of the U-shaped clasp 30 apart until the pin(s) 33 clear the bottom edge 37 of the mounting bar (see FIG. 3). Thereafter, the legs 31 of the U-shaped clasp snap back into a relatively snug fit with the mounting bar, to allow relative sliding movement of the U-shaped clasp along the length of the mounting bar, but otherwise preventing movement of the U-shaped clasp in directions lateral to the mounting bar. Moreover, once the pin(s) 33 have cleared the bottom edge 37 of the mounting bar, they provide some resistance to dislodgement of the clasp from the mounting bar (see FIG. 3).

The foregoing structure for coupling the U-shaped clasp with the mounting bar enables the position of a hanger arm along a mounting bar to be readily adjusted by sliding the U-shaped clasp of the hanger arm to a desired location on the mounting bar. The U-shaped clasp may, if desired, have bolt holes (not shown) which can be aligned with respective bolt holes in the mounting bar, and which enable the clasp to be bolted in a particular position on the mounting bar.

Each hanger arm 14 comprises a zinc-plated steel tube which extends forward from the mounting bar 12 and terminates in the mounting plate 18 at the forward end of the hanger arm 14. Each hanger arm 14 includes a slide (or descent) portion 32 (FIG. 3) which extends forward and angularly downward from the horizontal mounting bar 12. Preferably, the slide portion 32 extends angularly downward at an angle which is about 20° to the horizontal (see FIG. 3). Each hanger arm 14 also includes a front portion 34 which extends forward from the lower end of the slide portion 32, and at an angle to the slide portion 32. Preferably, the front portion 34 extends generally horizontal (see FIG. 3). Each mounting plate 18 is fixed (e.g., welded) to the forward end of the front portion 34 of the hanger arm. A stop pin 36 is disposed along the slide portion 32, preferably near the lower end of the slide portion 32 (see e.g., FIG. 3).

The slide portion 32 of the hanger arm 14 enables products suspended from the slide portion to slide downward under the influence of gravity. Thus, the slide portion enables suspended products to be closely stacked behind the stop pin 36 on the hanger arm 14. This feature helps support the products in a space efficient manner. The front portion 34 of the hanger arm provides a convenient product replacement area forward of the stop pin 36. When a customer removes a product for inspection, and then desires to replace the product, the product replacement area provides a convenient place for a customer to replace the product.

The mounting plates 18 at the forward ends of the hanger arms 14 act as supports for display devices associated with the products. For example, with the components illustrated in FIG. 1, a plurality of hanger arms 14, each of identical configuration, can each be adapted to be connected to a common horizontal mounting bar 12. With such an arrangement, the mounting plates 18 at the forward ends of the hanger arms would all be at a common height, and generally co-planar in relation to each other. The light fixture mounting channel 20, which can be formed of extruded plastic, has a mounting channel 38 on its backside that allows the channel to slide onto the co-planar mounting plates 18 at the forward ends of the hanger arms 14. The mounting channel 20 can accept a backlighting source (not shown) and defines tracks 40 which can support graphic display panels (not shown) which can be backlit by the light source. The display device can alternatively comprise the graphics channel 22 which is formed of extruded plastic and which has a mounting channel 42 on its back side to allow the graphics channel 22 to slide onto the co-planar mounting plates 18 to mount the graphics channel 22 on the mounting plates 18. The graphics channel 22 is configured to enable display material relating to the product, (e.g., graphic material, pricing and/or bar code caption materials or other information relative to the product), to be supported thereon.

A product/clip combination 50, designed to be suspended from a hanger arm 14 at any location rearward of the mounting plate 18, is illustrated in FIGS. 1, 2, and 4–8. As illustrated, the product/clip combination 50 comprises a glove 52 and a clip 54 releasably attached to the web 56 of the glove 52.

The clip 54 comprises a molded, one piece plastic structure configured to form a body portion 58, a hook 60 at the upper end of the body portion, and a resilient clamping structure 62 formed in one piece with the body portion 58. A recess 63, for receiving display material which relates to the product, can be formed in one face of the body portion 58. The hook 60 enables the clip 54 to be conveniently hung on a hanger arm 14, at any location along the hanger arm behind the mounting plate 18. The hook also enables product/clip combinations 50 to be conveniently removed from a hanger arm by moving the product/clip laterally relative to the hanger arm. The recess 63 enables display material (e.g., a logo or decal or product selection information) to be incorporated into the clip 54. The clamping structure 62 comprises a resiliently deflectable finger 66 formed in one piece with, but extending away from, the body portion 58. The resiliently deflectable finger 66 has a generally C-shaped configuration (see FIG. 6). Moreover, the body portion includes a pair of retainer pins 68 on the side of the body portion 58 which faces the resiliently deflectable finger 66 and disposed on opposite sides of the resiliently deflectable finger 66.

Figure 6:
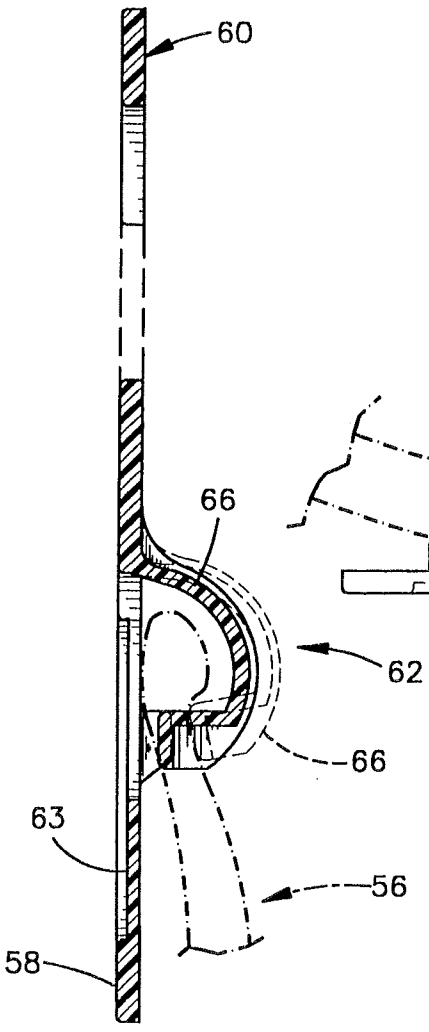
FIG. 6 is a sectional view of the product/clip combination of FIG. 5, taken from the direction 6—6.

The clamping structure 62 is designed to resiliently engage the web 56 of the glove 52. As illustrated in FIG. 6, the finger 66 can be bent away from the body portion 58, to allow the web 56 of the glove 52 to be inserted between the finger 66 and the body portion 58. The finger 66 is then released, to capture the web 56 of the glove between the finger and the body portion 58.

Figure 2:
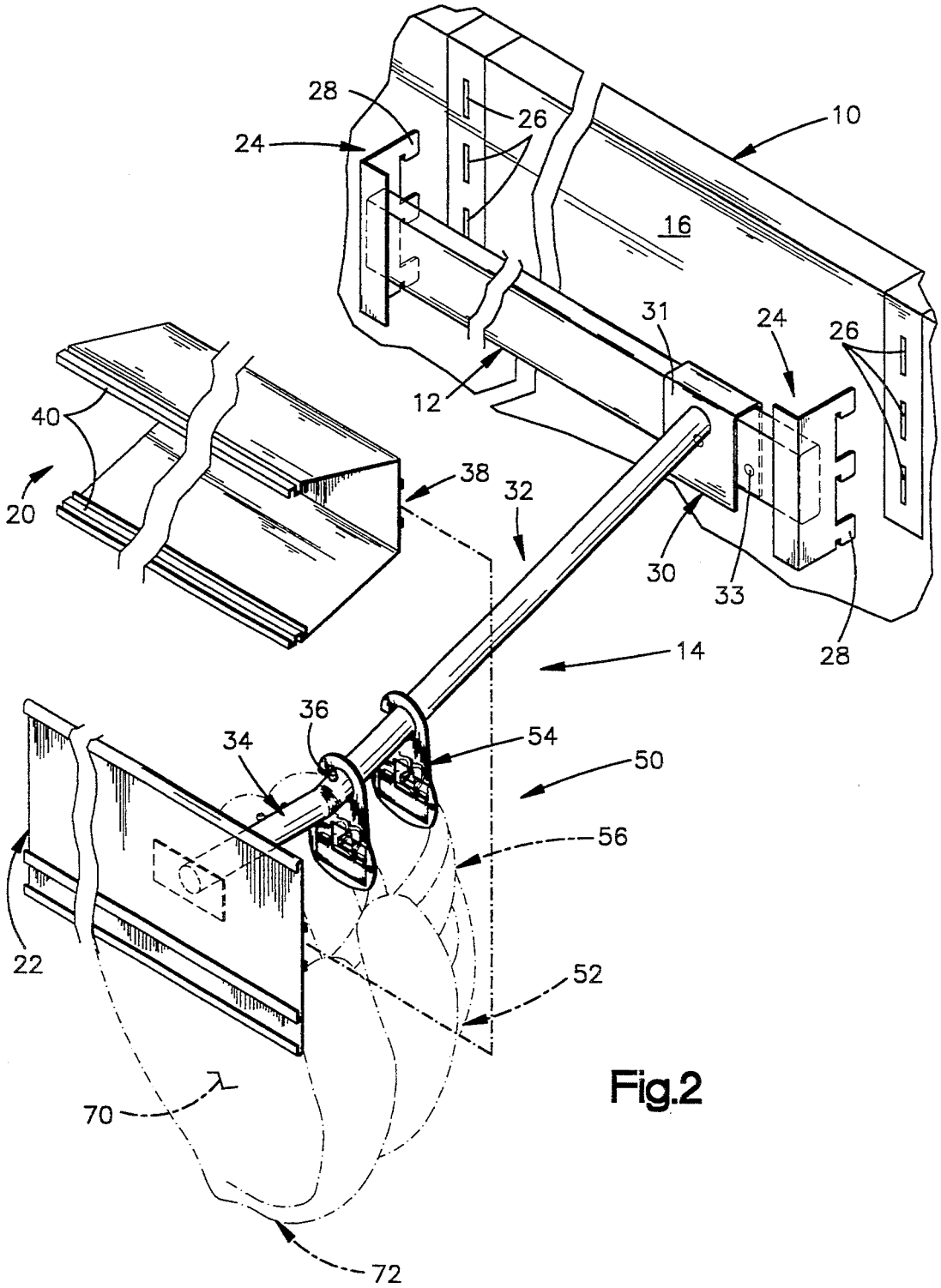
FIG. 2 is a schematic illustration of a product merchandising system according to the present invention, and showing how gloves are supported and displayed by the system.

Forming the product/clip combination 50 in the foregoing fashion offers several significant advantages. For example, the configuration of the clip enables product/clip combinations to be easily suspended from and removed from a hanger arm, anywhere along the hanger arm 14 behind the mounting plate 18. This makes the system consumer friendly, and makes it convenient for store personnel to replace, remove, or add to the stock of products supported and displayed by the system. Moreover, as illustrated in FIG. 2, when a clip 54 suspends a glove 52 from a hanger arm 14, the glove is oriented with its concave front face 70 facing generally forward and the hand opening 72 of the glove facing downward. Thus, when a plurality of gloves are suspended on the slide portion 32 of a hanger arm 14, the gloves can stack up one behind the other in as space efficient a manner as possible. Also, because the gloves have a common orientation, the system displays the gloves in an aesthetically attractive manner. Still further, because each clip engages the web of a respective glove, it should be clear that when a glove/clip combination is removed from a hanger arm for inspection by a customer, the customer can easily insert his/her hand into the glove to examine the feel of the glove, without removing the clip from the glove. Then, if the customer decides not to purchase the glove, the glove/clip combination can be replaced as a unit, thereby minimizing the risk of loss or separation of these elements in the event the customer elects not to purchase the glove. The product replacement section of the hanger arm provides a convenient location for enabling a customer to replace a glove/clip combination to the hanger arm. Preferably, a product replacement section about 6" in length is desirable to allow one or two glove/clip combinations to be returned to a hanger arm.

Thus, according to the foregoing description, applicant has provided a merchandising system which is believed to be particularly useful in the display of products such as gloves. The system enables gloves to be organized in ways that make it simple and efficient for a customer to make a selection of a glove that meets the customer's particular needs. For example, the system enables gloves to be organized by type, quality, price, etc. Moreover, the displays associated with the hanger arms inform customers as to what types of gloves are found on the hanger arms, what sport the gloves are used to play (e.g., baseball, softball), what position(s) the gloves are for (e.g., catcher's mitt, outfielder's glove, etc.), the price range(s) of the gloves, etc.

While a preferred embodiment of the system has been disclosed, variations on that embodiment are contemplated. For example, in the preferred embodiment, a mounting plate at the front end of a hanger arm, besides being designed to support a display device, also functions as a stop which prevents accidental dislodgement of a product/clip combination from the hanger arm. However, if it is desired to eliminate a display device at the front end of the hanger arm (e.g., if a display device for the system was supported directly on the upright fixture), a front piece, configured only to prevent accidental dislodgement of a product/clip combination from the hanger arm, could be used in place of a mounting plate.

Moreover, the principles of the present invention are believed applicable for providing product displays for various other types of products, as will be readily apparent to those of ordinary skill in the art.

I claim:

1. A product merchandising system comprising:

an upright store fixture and at least one hanger arm coupled with said upright store fixture;

said upright store fixture having a front side;

said hanger arm having (i) a gravity slide portion extending forwardly and angularly downward from a location on the front side of the upright store fixture, (ii) a stop member disposed on the gravity slide portion near the lower end thereof, (iii) a front portion extending forwardly from the lower end of the gravity slide portion, and (iv) a support device at the forward end of said front portion;

at least one product/clip combination suspended from said hanger arm, said product/clip combination comprising a product and a clip releasably engaging a predetermined portion of said product, said clip having a hook configured to releasably engage said hanger arm at any location rearward of said support device and to suspend the product/-clip combination therefrom; and said hook and said gravity slide portion of said hanger arm being configured to enable a product/clip combination suspended from said hanger arm to slide downward along said gravity slide portion under the influence of gravity when said hook engages said gravity slide portion, each product/-clip combination being removable from the hanger arm by moving the clip laterally relative to the hanger arm thereby to unhook the product/clip combination from the hanger arm.

2. A product merchandising system as defined in claim 1, wherein said support device comprises a plate coupled with the forward end of said hanger arm, and wherein a display device is connected with said support plate.

3. A product merchandising system as defined in claim 2, wherein said display device comprises a channel member coupled with said support plates and at least one segment of graphic material held by said channel member.

4. A product merchandising system as defined in claim 3, wherein said hanger arm has coupling structure at its rear end, said coupling structure configured to couple said hanger arm with said upright store fixture.

5. A product merchandising system as defined in claim 4, wherein a horizontal mounting bar is coupled to the front side of said upright store fixture, and said coupling structure at the rear end of said hanger arm is configured to engage said mounting bar to couple said hanger arm with said upright store fixture.

6. A product merchandising system as defined in claim 5, wherein said coupling structure is slidable along said mounting bar for adjusting the position of the hanger arm on the mounting bar.

7. A product merchandising system as defined in claim 2, wherein said clip comprises a one piece member configured to define (i) a body portion, (ii) said hook, and (iii) at least one spring finger extending away from said body portion and being resiliently deflectable relative to said body portion to enable the predetermined portion of the product to be captured between said spring finger and said body portion.

8. A product merchandising system as defined in claim 7, wherein said body portion includes a recess for receiving display material related to said product.

9. A product merchandising system as set forth in claim 1, including a plurality of hanger arms, each of which is coupled with said store fixture, each of said plurality of hanger arms having a configuration as set forth in claim 1, and each of said plurality of hanger arms having a plurality of product/clip combinations of the type set forth in claim 1 suspended therefrom.

10. A product merchandising system as set forth in claim 9, wherein a horizontal mounting bar is coupled to the front side of said upright store fixture, each of said of plurality of hanger arms having coupling structure at its rear end, the coupling structures at the rear ends of said plurality of hanger arms being configured to engage said horizontal mounting bar to couple said plurality of hanger arms with said upright store fixture.

11. A product merchandising system as set forth in claim 10, wherein the coupling structure of each hanger arm is slidable along the mounting bar for adjusting the position of the hanger arm relative to the mounting bar and to other hanger arms on the mounting bar.

12. A product merchandising system as set forth in claim 10, wherein said plurality of hanger arms are identical in configuration and dimension, so that the support devices at the forward ends of the plurality of hanger arms are disposed at a substantially common height relative to said upright store fixture.

13. A product merchandising system as set forth in claim 10 further comprising a display device attached to the support device at the forward ends of the plurality of hanger arms, said display device being adapted to display information relating to products on the hanger arms.

14. A product merchandising system as set forth in any of claims 1–3, wherein each product forming part of a product/clip combination comprises a glove, and each clip releasably engages a predetermined portion of a respective glove and suspends the glove in a predetermined orientation when the hook portion of said clip engages a hanger arm.

15. A product merchandising system as set forth in claim 14, wherein each glove includes a hand opening, a concave front face with a pocket and a web spaced from the hand opening, and wherein each clip releasably engages the web of a respective glove and suspends the glove from the hanger arm with the pocket of the glove facing the forward end of the hanger arm.

16. A product merchandising system as set forth in claim 1, wherein said front portion of the hanger arm extends generally horizontally forward from the lower end of the gravity slide portion.

17. A product merchandising system as set forth in claim 16, wherein said front portion of the hanger arm has a length sufficient to allow convenient placement of at least one product/clip combination thereon.

18. A product merchandising system comprising:

an upright store fixture and a plurality of hanger arms coupled with said upright store fixture;

said upright store fixture having a front side;

each hanger arm having (i) a gravity slide portion extending forwardly and angularly downward from a location on the front side of the upright store fixture, (ii) a front portion extending forwardly from the lower end of the gravity slide portion, and (iii) a support device at the forward end of said front portion;

at least one product/clip combination suspended from each hanger arm, said product/clip combination comprising a product and a clip releasably engaging a predetermined portion of said product, said clip having a hook configured to releasably engage said hanger arm at any location rearward of said support device and to suspend the product/-clip combination therefrom;

said hook and said gravity slide portion of each hanger arm being configured to enable a product/-clip combination suspended from said hanger arm to slide downward along said gravity slide portion under the influence of gravity when said hook engages said gravity slide portion, each product/-clip combination being removable from the hanger arm by moving the clip laterally relative to the hanger arm thereby to unhook the product/clip combination from the hanger arm, said plurality of hanger arms being identical in configuration and dimension, so that the support devices at the forward ends of the plurality of hanger arms are disposed at a substantially common height relative to said upright store fixture, and a display device attached to the support device at the forward ends of the plurality of hanger arms, said display device being adapted to display information relating to products on the hanger arms.

19. A product merchandising system comprising:

an upright store fixture and at least one hanger arm coupled with said upright store fixture;

said upright store fixture having a front side;

said hanger arm having (i) a gravity slide portion extending forwardly and angularly downward from a location on the front side of the upright store fixture, (ii) a stop member disposed on the gravity slide portion near the lower end thereof, (iii) a front portion extending forwardly from the lower end of the gravity slide portion, and (iv) a front piece at the forward end of said front portion;

at least one product/clip combination suspended from said hanger arm, said product/clip combination comprising a product and a clip releasably engaging a predetermined portion of said product, said clip having a hook configured to releasably engage said hanger arm at any location rearward of said front piece and to suspend the product/clip combination therefrom; and said hook and said gravity slide portion of said hanger arm being configured to enable a product/clip combination suspended from said hanger arm to slide downward along said gravity slide portion under the influence of gravity when said hook engages said gravity slide portion, each product/-clip combination being removable from the hanger arm by moving the clip laterally relative to the hanger arm thereby to unhook the product/clip combination from the hanger arm.

* * * * *